US010434774B2

(12) United States Patent
Chen et al.

(10) Patent No.: US 10,434,774 B2
(45) Date of Patent: Oct. 8, 2019

(54) FLUID EJECTION DIE AND GLASS-BASED SUPPORT SUBSTRATE

(71) Applicant: Hewlett-Packard Development Company, L.P., Houston, TX (US)

(72) Inventors: Chien-Hua Chen, Corvallis, OR (US); Michael W. Cumbie, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/761,202

(22) PCT Filed: Nov. 2, 2015

(86) PCT No.: PCT/US2015/058564
§ 371 (c)(1),
(2) Date: Mar. 19, 2018

(87) PCT Pub. No.: WO2017/078664
PCT Pub. Date: May 11, 2017

(65) Prior Publication Data

US 2018/0264813 A1 Sep. 20, 2018

(51) Int. Cl.
*B41J 2/14* (2006.01)
*B41J 2/145* (2006.01)

(52) U.S. Cl.
CPC ..... *B41J 2/1433* (2013.01); *B41J 2/145* (2013.01)

(58) Field of Classification Search
CPC ..... B41J 2/14; B41J 2/145; B41J 2/155; B41J 2/16; B41J 2/1623; B41J 2/1635; B41J 2/1637; B41J 2/1433
See application file for complete search history.

(56) References Cited

U.S. PATENT DOCUMENTS

| | | | | |
|---|---|---|---|---|
| 6,435,653 | B1 | 8/2002 | Boyd et al. | |
| 6,931,702 | B2 | 8/2005 | Mitsuhashi | |
| 7,882,636 | B2 | 2/2011 | Mita et al. | |
| 8,342,653 | B2 * | 1/2013 | Akahane | B41J 2/2135 347/49 |
| 8,556,389 | B2 | 10/2013 | Golda et al. | |
| 2004/0021740 | A1 | 2/2004 | Bell et al. | |
| 2006/0203078 | A1 | 9/2006 | Naugler et al. | |

(Continued)

FOREIGN PATENT DOCUMENTS

JP 2000079686 3/2000

OTHER PUBLICATIONS

Lim, et al., "T-jet: A Novel Thermal Inkjet Printhead with Monolithically Fabricated Nozzle Plate on SOI Wafer", Jun. 8-12, 2003, The 12th International Conference on Solid State Sensors, Actuators and Microsystems, Boston.

*Primary Examiner* — Lamson D Nguyen
(74) *Attorney, Agent, or Firm* — HP Inc. Patent Department

(57) ABSTRACT

Examples include a glass-based support substrate and at least one fluid ejection die coupled thereto. The at least one fluid ejection die comprises nozzles for dispensing printing material. The glass-based support substrate has a fluid communication channel formed therethrough, where the fluid communication channel is in fluid communication with the nozzles of the at least one fluid ejection die.

14 Claims, 9 Drawing Sheets

(56) References Cited

U.S. PATENT DOCUMENTS

| | | | |
|---|---|---|---|
| 2008/0252694 | A1 | 10/2008 | Silverbrook |
| 2010/0229391 | A1 | 9/2010 | Bernard et al. |
| 2011/0025782 | A1 | 2/2011 | Haluzak et al. |
| 2011/0037808 | A1 | 2/2011 | Ciminelli et al. |

* cited by examiner

FLUID EJECTION DIE AND GLASS-BASED SUPPORT SUBSTRATE

BACKGROUND

Printers are devices that deposit a fluid, such as ink, on a print medium, such as paper. A printer may include a printhead that is connected to a printing material reservoir. The printing material may be expelled, dispensed, and/or ejected from the printhead onto a physical medium.

DRAWINGS

Throughout the drawings, identical reference numbers designate similar, but not necessarily identical, elements. The figures are not necessarily to scale, and the size of some parts may be exaggerated to more clearly illustrate the example shown.

DESCRIPTION

Figure 1:
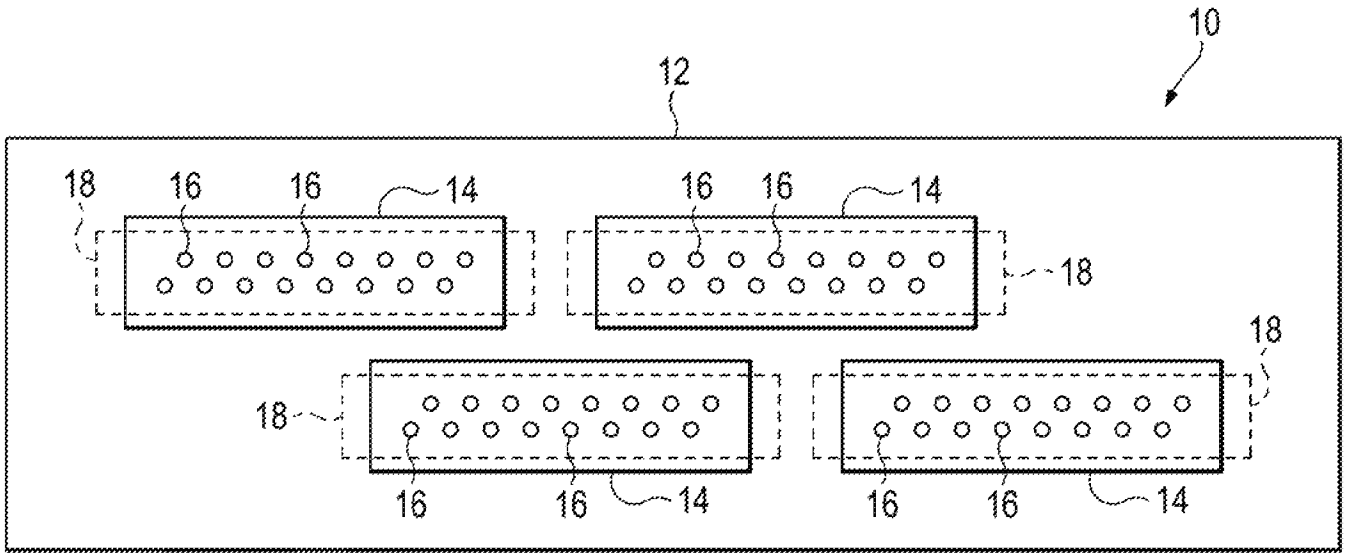
FIG. 1 is a top view of some components of an example fluid ejection device.

Examples of fluid ejection devices may comprise at least one fluid ejection die and a glass-based support substrate coupled to the at least one fluid ejection die. Some examples of a fluid ejection device are printheads, where a printhead may comprise at least one fluid ejection die coupled to a glass-based support substrate. Each fluid ejection die comprises a plurality of nozzles, where each nozzle may dispense printing material. Printing material, as used herein, may comprise ink, toner, fluids, powders, colorants, varnishes, finishes, gloss enhancers, binders, and/or other such materials that may be utilized in a printing process. Each fluid ejection die comprises at least one fluid feed hole for each respective nozzle of the plurality of nozzles. Each fluid feed hole is in fluid communication with the respective nozzle to thereby convey printing material to the nozzle for dispensation by the respective nozzle. The glass-based support substrate has a fluid communication channel formed therethrough in fluid communication with the at least one feed hole. In such examples, a printing material reservoir may be fluidly connected to the nozzles of the fluid ejection device via the fluid communication channel and the fluid feed holes.

Examples provided herein include fluid ejection devices, such as printheads, that comprise a glass-based support substrate and a plurality of fluid ejection dies coupled to the support substrate. Each fluid ejection die of the plurality may comprise a plurality of nozzles to dispense printing material. The glass-based support substrate may have a plurality of fluid communication channels formed therethrough, where each fluid ejection die of the plurality may be in fluid communication with a respective fluid communication channel. As will be appreciated, printing material may be conveyed via the fluid communication channels to nozzles of each fluid ejection die for dispensation therewith.

Nozzles eject printing material under control of a controller or other integrated circuit to form printed content with the printing material on a physical medium. Nozzles may include ejectors to cause printing material to be ejected/dispensed from a nozzle orifice. Some examples of types of ejectors implemented in fluid ejection devices include thermal ejectors, piezoelectric ejectors, and/or other such ejectors that may cause printing material to eject/be dispensed from a nozzle orifice. In some examples, fluid ejection dies may be referred to as slivers. In some examples the fluid ejection dies may be formed with silicon or a silicon-based material. Various features, such as nozzles, may be formed from various materials used in silicon device based fabrication, such as silicon dioxide, silicon nitride, metals, epoxy, polyimide, other carbon-based materials, etc. As described herein, a sliver may correspond to a fluid ejection die having: a thickness of approximately 650 μm or less; exterior dimensions of approximately 30 mm or less; and/or a length to width ratio of approximately 3 to 1 or larger.

Example fluid ejection devices, as described herein, may be implemented in printing devices, such as two-dimensional printers and/or three-dimensional printers (3D). In some examples, a fluid ejection device may be implemented into a printing device and may be utilized to print content onto a media, such as paper, a layer of powder-based build material, reactive devices (such as lab-on-a-chip devices), etc. Example fluid ejection devices include ink-based ejection devices, digital titration devices, 3D printing devices, pharmaceutical dispensation devices, lab-on-chip devices, fluidic diagnostic circuits, and/or other such devices in which amounts of fluids may be dispensed/ejected. In some examples, a printing device in which a fluid ejection device may be implemented may print content by deposition of consumable fluids in a layer-wise additive manufacturing process. Generally, consumable fluids and/or consumable materials may include all materials and/or compounds used, including, for example, ink, toner, fluids or powders, or other raw material for printing. Generally, printing material, as described herein may comprise consumable fluids as well as other consumable materials. Printing material may comprise ink, toner, fluids, powders, colorants, varnishes, finishes, gloss enhancers, binders, and/or other such materials that may be utilized in a printing process.

In some examples, the glass-based support substrate of a fluid ejection device may comprise one or more glass-based materials. Examples of such glass-based materials include fused silica glass, quartz glass, soda-lime glass, borosilicate glass (e.g., Pyrex, Schott Glass 8830, Schott Borofloat, Corning 7740, etc.), aluminosilicate glass, alkaline earth boro-aluminosilicate (e.g., Corning Eagle XG, etc.), alkali-aluminosilicate (e.g., Corning Gorilla Glass, etc.), photosensitive/photodefinable glass (e.g., Foturan glass, APEX glass, etc.), other silica based glass, polymer glass, and/or other such types of glass, or any combination thereof.

Furthermore, examples include processes for forming fluid ejection devices. In such examples fluid ejection dies may be coupled to a glass-based support substrate. After coupling of the fluid ejection dies and the glass-based support substrate, fluid communication channels that are aligned to and in fluid communication with fluid feed holes and nozzles of the fluid ejection dies may be formed through the glass-based support substrate. By coupling the fluid ejection dies to the glass-based support substrate prior to forming of the fluid communication channels, examples facilitate alignment of the fluid ejection dies and the fluid communication channels. As used herein, such aligned fluid communication channels may be referred to as "self-aligned" fluid communication channels or simply aligned fluid communication channels. It will be appreciated that fluid communication channels described herein are aligned to the fluid ejection dies, the fluid feed holes of the fluid ejection dies, and the nozzles of the fluid ejection dies. Furthermore, removing portions of the glass-based support substrate after coupling of the fluid ejection dies facilitates removal of debris or manufacturing materials that may limit fluid communication between the fluid communication channels and the fluid feed holes and nozzles of the fluid ejection dies.

Turning now to the figures, and particularly to FIG. 1, this figure provides a top view of some components of an example fluid ejection device 10. As shown in this example, the fluid ejection device 10 comprises a glass-based support substrate 12 and a plurality of fluid ejection dies 14 coupled thereto. As shown, each fluid ejection die 14 comprises a plurality of nozzles 16, where the nozzles 16 are to dispense printing material. In this example, fluid communication channels 18 that are formed through the glass-based support substrate 12 are illustrated in phantom, where the fluid ejection device 10 has a fluid communication channel 18 for each fluid ejection die 14. As will be appreciated, the fluid communication channel 18 for each fluid ejection die 14 is in fluid communication with the nozzles of the fluid ejection die 14 such that printing material may be conveyed to the nozzles of the fluid ejection die 14 for dispensing thereby. As will be further appreciated, the fluid communication channel for each fluid ejection die 14 is aligned with the nozzles 16 of the fluid ejection die 14.

Figure 2:
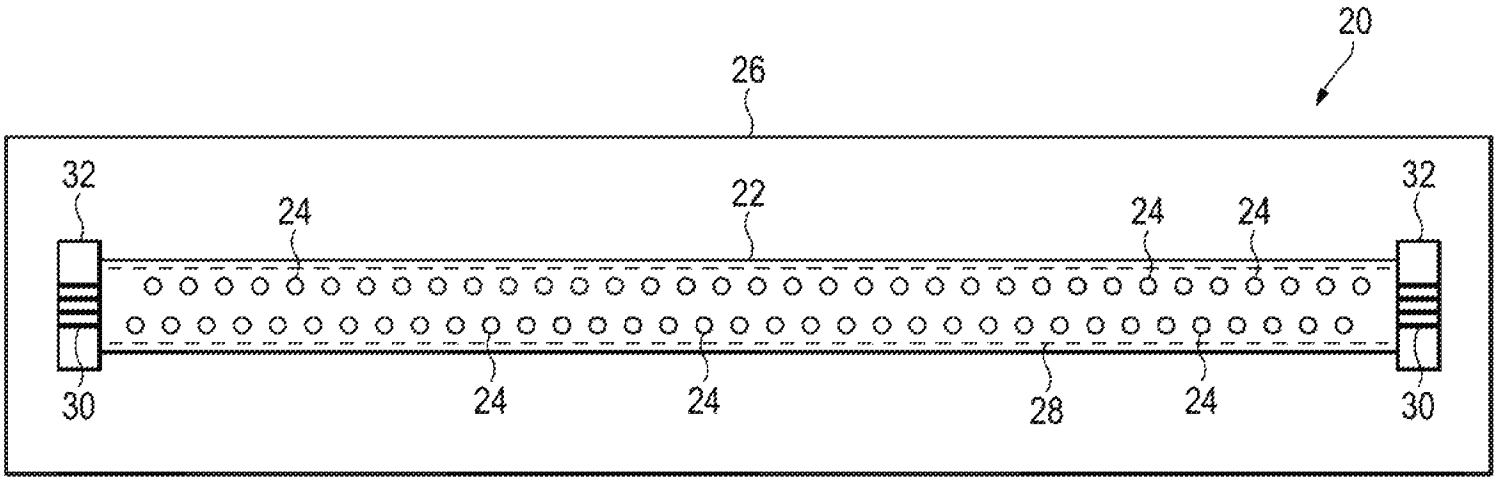
FIG. 2 is a top view of some components of an example fluid ejection device.

FIG. 2 provides a top view of some components of an example fluid ejection device 20. As shown, the example fluid ejection device 20 comprises at least one fluid ejection die 22, where the fluid ejection die 22 comprises a plurality of nozzles 24 to dispense printing material. The fluid ejection die 22 is coupled to a glass-based support substrate 26. In addition, a fluid communication channel 28 is illustrated with a dashed line, where the fluid communication channel 28 passes through the glass-based support substrate and is in fluid communication with the nozzles 24 of the fluid ejection die 22. Moreover, the fluid communication channel 28 is aligned with the nozzles 24 of the fluid ejection die 22. In this example, conductive traces 30 are connected to the fluid ejection die 22. The conductive traces 30 may electrically connect the fluid ejection die 22 to a controller, integrated circuit, print engine, or other such hardware components that may control the dispensation of printing material from nozzles 24 of the fluid ejection die 22. Furthermore, the conductive traces 30 may pass through conductive trace openings formed in the glass-based support substrate, such that the conductive traces may electrically connect to the fluid ejection die 22 on a top surface of the glass-based support substrate 26, and the conductive traces may be routed to a controller on a bottom surface of the glass-based support substrate. In the example fluid ejection device 20 of FIG. 2, the conductive traces 30 may be encapsulated with an insulating material 32. Furthermore, the encapsulation may electrically insulate the connection of the conductive traces 30 and the fluid ejection die 22, and the encapsulation may seal the connection of the conductive traces 30 and the fluid ejection die 22 to protect the conductive traces 30 and/or the fluid ejection die from environmental conditions/elements (such as printing material and/or moisture). While not shown in the example, an integrated circuit (IC), controller, or other such component may be electrically connected to the fluid ejection die 22 via the conductive traces 30.

Figure 3:
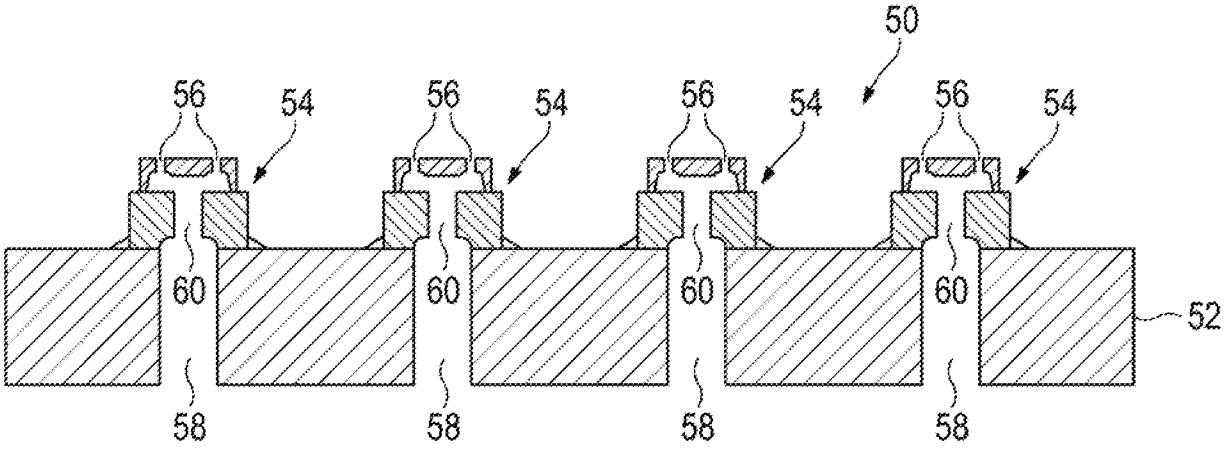
FIG. 3 is cross-sectional view of an example fluid ejection device.

FIG. 3 provides a cross-sectional view of an example fluid ejection device 50. As shown, the fluid ejection device 50 comprises a glass-based support substrate 52 and a plurality of fluid ejection dies 54 coupled to the glass-based support substrate 52. As shown, each fluid ejection die 54 comprises nozzles 56 to dispense printing material. In this example, the glass-based support substrate 52 has a fluid communication channel 58 formed therethrough for each fluid ejection die 54. Each fluid ejection die 54 has at least one fluid feed hole 60 formed therethrough, where the fluid feed hole 60 is in fluid communication with the nozzles 56 of the fluid ejection die 54 and the fluid communication channel 58 of the glass-base support substrate 52. Furthermore, as shown in this example, the fluid communication channels 58 are aligned with the fluid feed holes 60 of the fluid ejection dies 54. Accordingly, printing material may be conveyed from a printing material reservoir to the nozzles 56 for dispensing via the fluid communication channels 58 and the fluid feed holes 60.

Figure 4:
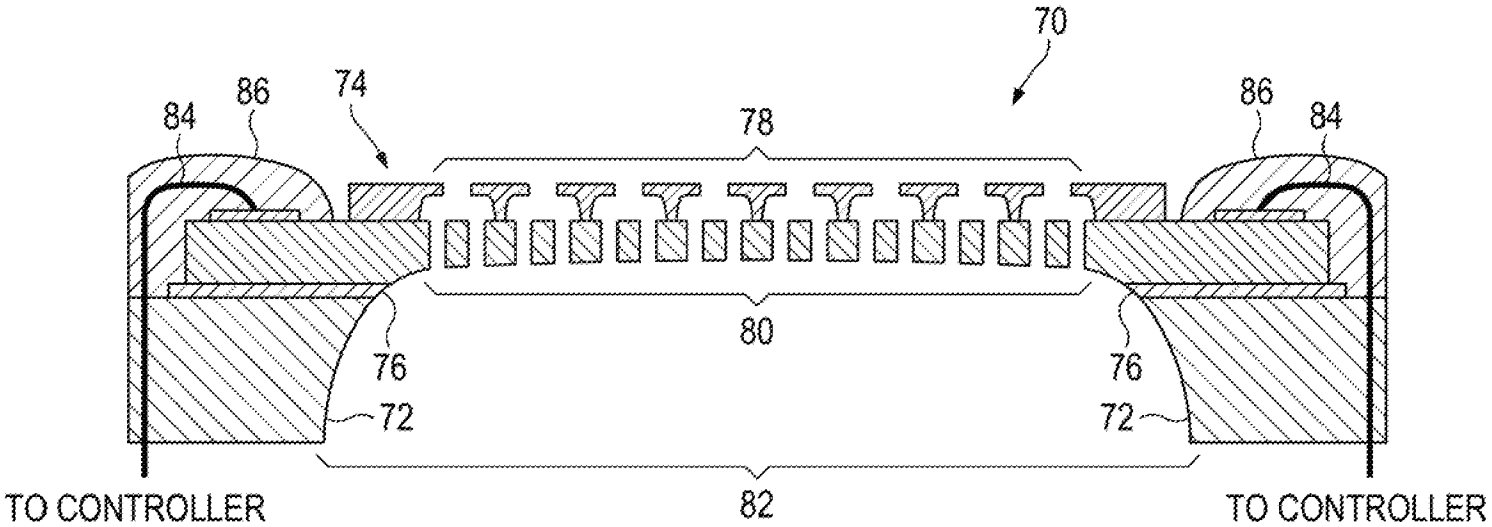
FIG. 4 is a cross-sectional view of an example fluid ejection device.

FIG. 4 provides a cross sectional view of an example fluid ejection device 70. In this example, the fluid ejection device 70 comprises a glass-based support substrate 72 and a fluid ejection die 74 coupled to the glass-based support substrate 72. As will be appreciated, the fluid ejection device 70 may comprise additional fluid ejection dies not visible in the cross sectional view. In this example, the fluid ejection die 74 is coupled to the glass-based support substrate 72 with an adhesive 76. In some examples of fluid ejection devices and/or fluid ejection devices descried herein example adhesives may include adhesive tape, epoxy-based adhesive, such as Loctite DP10005, etc.

While in this example the fluid ejection die 74 is coupled to the glass-based support substrate 72 with adhesive 76, it will be appreciated that in other examples a fluid ejection die may be coupled to a glass-based support substrate by bonding, overmolding, etc. In some examples, the adhesive may correspond to an adhesive tape, where the adhesive tape may include a first adhesive material on a first surface of the tape with which to couple to the fluid ejection dies, and the adhesive tape may include a second adhesive material on a second surface of the tape with which to couple to the glass-based support substrate.

Returning to FIG. 4, as shown, the fluid ejection die 74 comprises a plurality of nozzles 78, where the nozzles 78 may dispense printing material. Fluid feed holes 80 are formed through the fluid ejection die 74, and a fluid communication channel 82 is formed through the glass-based support substrate 72. The fluid feed holes 80 are in fluid communication with the nozzles 78 and the fluid communication channel 82 such that printing material may be conveyed to the nozzles 78 via the fluid communication channel 82 and the fluid feed holes 80. Furthermore, as shown, the fluid communication channel 82 is aligned with the fluid feed holes 80 such that the adhesive 76 or portions of the glass-based substrate 72 may not impede flow of printing material from the fluid communication channel 82 to the nozzles 78.

In this example, conductive traces 84 are electrically connected to the fluid ejection die 74. In addition, the conductive traces 84 pass through conductive trace openings formed through the glass-based support substrate 72. In addition, the fluid ejection device 70 comprises an insulating material 86 that encapsulates a portion of the conductive traces 84 and the fluid ejection die 74 such that the electrical connection between the fluid ejection die 74 and the conductive traces 84 is electrically insulated. As will be appreciated, the encapsulation with the insulating material may further seal and protect the conductive traces 84 and the electrical connection of the conductive traces 84 to the fluid ejection die 74 from environmental conditions, such as printing material and/or moisture. Furthermore, as shown, the conductive traces 84 may be electrically connected to a controller such that the controller may control dispensing of printing material with nozzles 78 of the fluid ejection die 74. As will be appreciated, a controller may comprise an application specific integrated circuit (ASIC), a general purpose processor, and/or other such logical components for data processing. The controller may control ejectors of the nozzles 78 to selectively dispense printing material from the nozzles 78.

Figure 5:
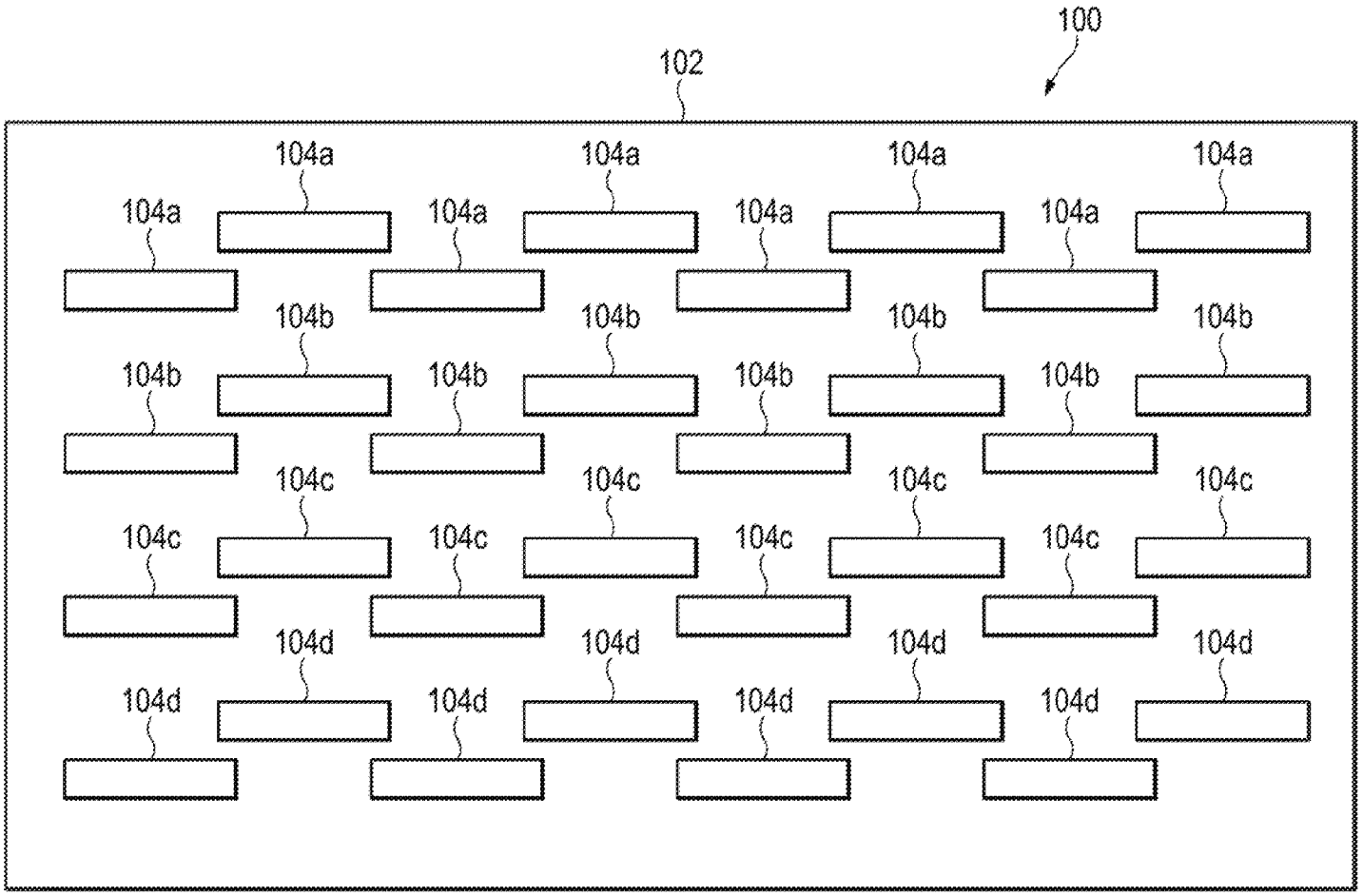
FIG. 5 is a top view of some components of an example fluid ejection device.

FIG. 5 provides a top view of a fluid ejection device 100. In this example, the fluid ejection device 100 comprises a glass-based support substrate 102 and a plurality of fluid ejection dies 104*a-d* coupled to the glass-based support substrate 102. As shown, the fluid ejection dies 104*a-d* are generally arranged end-to-end along a width of the glass-based support substrate 102. In some examples, the fluid ejection device 100 may be implemented in a page-wide, fixed printhead, printing device. In such examples, the fluid ejection dies 104*a-d* may be arranged generally end-to-end along the width of the fluid ejection device 100 and glass-based support substrate 102, where the width of the fluid ejection device 100 corresponds to a printing width of a printing device into which the fluid ejection device 100 may be implemented.

Furthermore, in some examples, such as the example shown in FIG. 5, the fluid ejection dies 104*a-d* may be arranged in sets that correspond to a printing order. For example, a first set of fluid ejection dies 104*a* may correspond to a first printing order; a second set of fluid ejection dies 104*b* may correspond to a second printing order; a third set of fluid ejection dies 104*c* may correspond to a third printing order; and a fourth set of fluid ejection dies 104*d* may correspond to a fourth printing order. In some examples, a printing order may correspond to an order in which a color of a printing material and/or a type of printing material is dispensed onto a physical medium during a printing process. For example, in a cyan, magenta, yellow, and black (CMYK) color printing process: a black color printing material may have a first printing order; a cyan printing material may have a second printing order; a magenta color printing material may have a third printing order; and a yellow color printing material may have a fourth printing order. To illustrate by way of example, if the example fluid ejection device 100 of FIG. 5 were implemented in a CMYK printing device/process, the first set of fluid ejection dies 104*a* may dispense a black color printing material; the second set of fluid ejection dies 104*b* may dispense a cyan color printing material; the third set of fluid ejection dies 104*c* may dispense a magenta color printing material; and the fourth set of fluid ejection dies 104*d* may dispense a yellow color printing material.

While the example of fluid ejection device 100 is illustrated with four sets of fluid ejection dies 104*a-d*, other examples may comprise various arrangements of fluid ejection dies based on the printing processes and printing devices into which the examples may be implemented. Moreover, while examples have been described with regard to dispensation of colorant printing materials, other examples may dispense other types of printing materials, such as binders, gloss enhancers, varnishes, etc.

Figure 6:
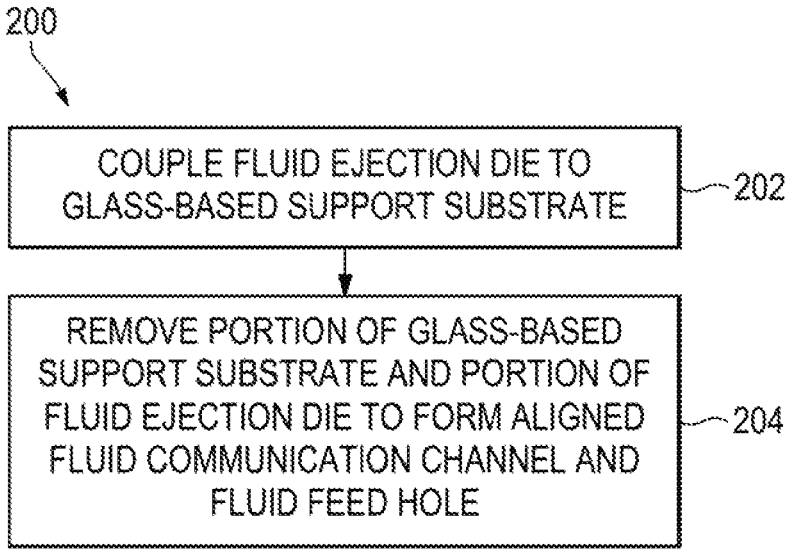
FIG. 6 is a flowchart of an example process.

FIG. 6 provides a flowchart that illustrates an example process 200 that may be performed to form a fluid ejection device. At least one fluid ejection die is coupled to a glass-based support substrate (block 202), and a portion of the glass-based support substrate is removed to form a self-aligned fluid communication channel (block 204). As will be appreciated, the fluid communication channel is in fluid communication with nozzles of the at least one fluid ejection die. Furthermore, example processes described herein may couple fluid ejection dies and the glass-based support substrate prior to forming of the fluid communication channels. Therefore, the fluid communication channels may be aligned to the fluid ejection dies such that nozzles and fluid feed holes of the fluid ejection dies are aligned with and in fluid communication with the fluid communication channels.

Figure 7:
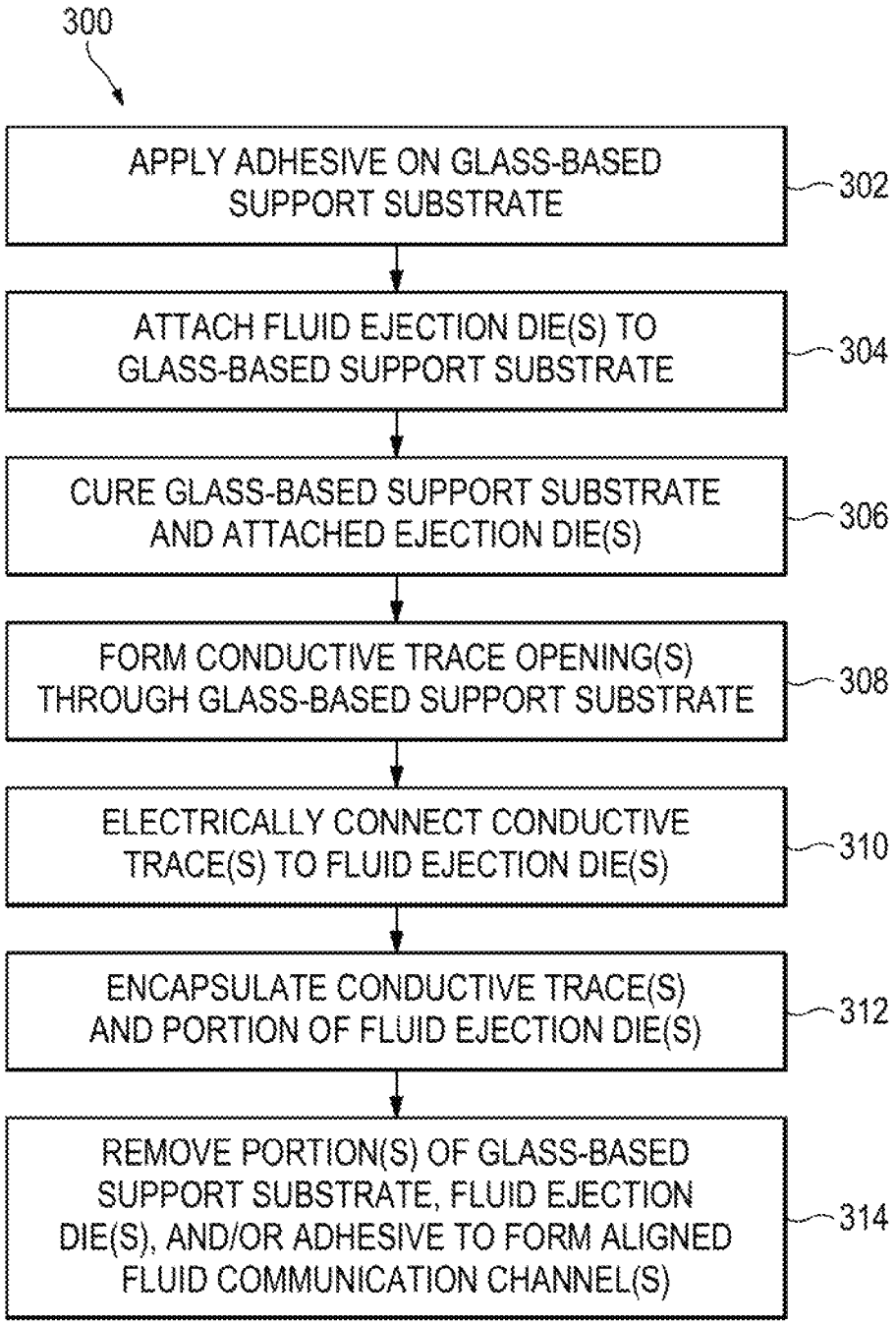
FIG. 7 is a flowchart of an example process.

FIG. 7 provides a flowchart that illustrates an example process 300 that may be performed to form a fluid ejection device. An adhesive is applied to a glass-based support substrate (block 302). Generally, the adhesive is applied at a position of the glass-based support substrate where a fluid ejection die is to be coupled. Fluid ejection dies are attached to the glass-based support substrate via the adhesive (block 304), and the attached fluid ejection dies and glass-based support substrate are cured (block 306) such that the adhesive bond between the fluid ejection dies, glass-based support substrate, and adhesive is strengthened. In some examples, curing the glass-based support substrate and attached fluid ejection dies may comprise Loctite ECCO-BOND DP1000 which may be cured at approximately 140° C. for approximately 5 minutes.

Conductive trace openings are formed through the glass-based support substrate (block 308). In some examples, conductive trace openings may be formed by laser cutting such openings through the glass-based support substrate, and conductive traces may be routed therethrough. Conductive traces are electrically connected to the fluid ejection dies (block 310). In some examples, electrically connecting the fluid ejection dies comprises wire bonding conductive traces to bond pads of the fluid ejection dies. The conductive traces and at least a portion of the fluid ejection dies associated with the electrical connection are encapsulated with an insulating material (block 312). In some examples, the insulating material is applied to cover the bond pad and the conductive traces bonded thereto. In some examples, encapsulating the conductive traces and portions of the fluid ejection dies may comprise encapsulating with Henkel FP1530, which may be cured at 160° C. for 7 minutes.

Portions of the glass-based support substrate, the adhesive, and/or the fluid ejection dies may be removed to form fluid communication channels through the glass-based support substrate (block 314). In some examples, removing portions of the glass-based support substrate, fluid ejection dies, and/or adhesive may comprise plunge-cut slotting the glass-based support substrate, fluid ejection dies, and/or adhesive. In other examples, removing portions of the glass-based support substrate, fluid ejection dies, and/or adhesive may comprise laser-cutting the glass based support substrate, fluid ejection dies, and/or adhesive. Other examples may implement other types of micromachining to form the fluid communication channels. As will be appreciated, the fluid communication channels are formed such that the fluid communication channels are in fluid communication with nozzles and feed holes of the fluid ejection dies. Moreover, the fluid communication channels that are formed through the glass-based support substrate may be aligned with the fluid feed holes and nozzles of the fluid ejection dies.

Figure 8:
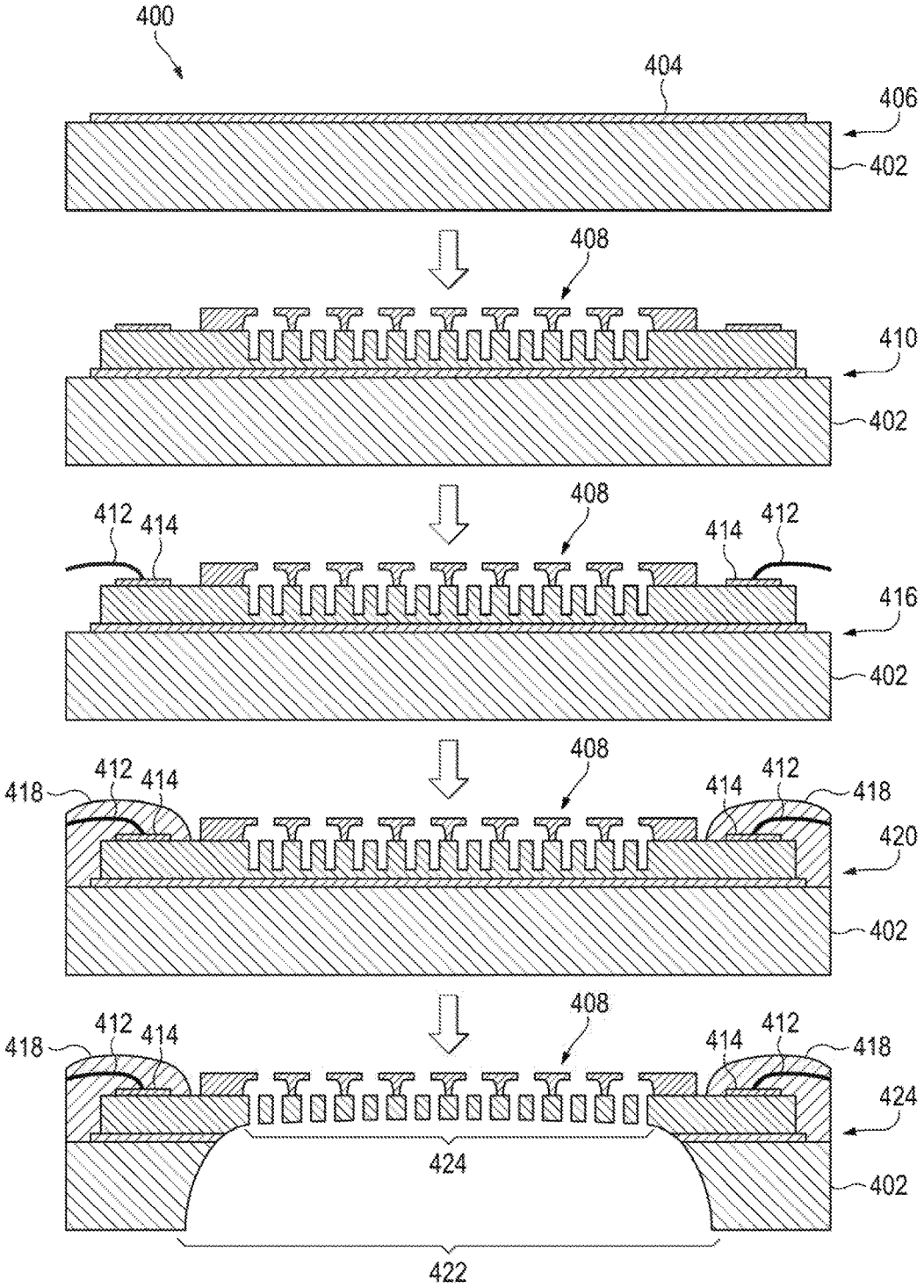
FIG. 8 is a flow diagram for an example process for forming a fluid ejection device.

FIG. 8 provides a flow diagram of an example process 400 for forming a fluid ejection device. In this example, a glass-based support substrate 402 is processed by dispensing adhesive 404 onto a top surface of the glass-based support substrate 402 (block 406). A fluid ejection die 408 is coupled to the glass-based support manifold 402 with the adhesive 404 (block 410). The fluid ejection die 408 is electrically connected to conductive traces 412 (e.g., conductive wire) by coupling a respective conductive trace 412 to a bond pad 414 of the fluid ejection die 408 (block 416). In addition, the conductive elements 412 and bond pads 414 may be encapsulated with an insulating material 418 (block 420). A fluid communication channel 422 is formed through the glass-based support substrate 402, the adhesive 404, and/or the fluid ejection die 408 and fluidly connected to nozzles of the fluid ejection die 408 (block 424). As discussed previously, example fluid communication channels 422 may be aligned with the fluid feed holes 424 and nozzles of the fluid ejection dies 408.

As shown in this example, the fluid communication channel 422 is formed through removal of a portion of the glass-based support substrate 402, some of the adhesive 404, and a portion of the fluid ejection die 408. By removing the portion of the glass-based support substrate 402, adhesive 404, and a portion of the fluid ejection die after the other processing operations, examples may reduce debris or other materials from blocking and/or partially blocking the fluid communication between the fluid communication channel 422 and the fluid feed holes. Furthermore, as shown in the example, removal of the portion of the fluid ejection die 408 generally forms an opening between the fluid feed holes 424 and the fluid communication channel 422.

Figure 9:
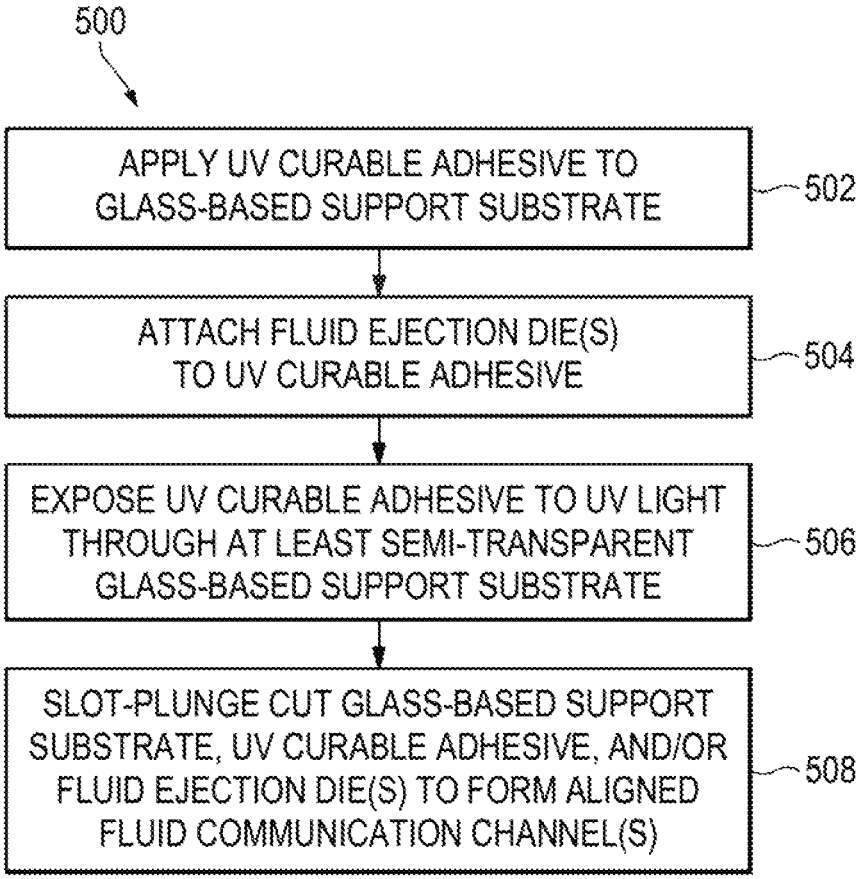
FIG. 9 is a flowchart of an example process.

FIG. 9 provides a flowchart that illustrates an example process 500 that may be performed during fabrication of a fluid ejection device and/or fluid ejection device. In this example, an ultraviolet (UV) light curable adhesive may be applied to a top surface of a glass-based support substrate (block 502). In some examples, the glass-based support substrate is at least semi-transparent such that light may be transmitted through the glass-based support substrate. In some examples, the UV light curable adhesive may comprise EPO-TEK OGI 16-31 curable Epoxy. At least one fluid ejection die is attached to the UV curable adhesive on the glass-based support substrate to thereby couple the glass-based support substrate and the at least one fluid ejection die (block 504). The UV curable adhesive may be exposed to UV light transmitted through the at least semi-transparent glass-based support substrate (block 506). At least one fluid communication channel for each of the at least one fluid ejection dies is formed by slot-plunge cutting the glass-based support substrate, the UV curable adhesive, and/or the at least one fluid ejection die (block 508).

Accordingly, examples provided herein may implement a glass-based support substrate having fluid communication channels formed therethrough. As will be appreciated, coupling of fluid ejection dies to a glass-based support substrate having fluid communication channels formed therethrough may facilitate printing material conveyance to nozzles for dispensation. In addition, such fluid ejection die and glass-based support substrate fluid ejection devices may be structurally resistant to materials used in printing materials. Furthermore, in some examples, the fluid ejection dies may be directly coupled to the glass-based support substrate with an adhesive, where the fluid communication channels of the glass-based support substrate facilitate delivery of printing material from a printing material reservoir to nozzles of the fluid ejection dies.

Various types of glass-based materials may be implemented in a glass-based support substrate. Examples of such materials include fused silica glass, quartz glass, soda-lime glass, borosilicate glass (e.g., Pyrex, Schott Glass 8830, Schott Borofloat, Corning 7740, etc.), aluminosilicate glass, alkaline earth boro-aluminosilicate (e.g., Corning Eagle XG, etc.), alkali-aluminosilicate (e.g., Corning Gorilla Glass, etc.), photosensitive/photodefinable glass (e.g., Foturan glass, APEX glass, etc.), other silica based glass, polymer glass, and/or other such types of glass, or any combination thereof.

The preceding description has been presented to illustrate and describe examples of the principles described. This description is not intended to be exhaustive or to limit these principles to any precise form disclosed. Many modifications and variations are possible in light of the description. Therefore, the foregoing examples provided in the figures and described herein should not be construed as limiting of the scope of the disclosure, which is defined in the Claims.

The invention claimed is:

1. A fluid ejection device comprising:

a glass-based support substrate having a plurality of fluid communication channels formed therethrough, the glass-based support substrate having conductive trace openings formed therethrough;

a plurality of fluid ejection dies coupled to a first surface of the support substrate, each fluid ejection die of the plurality comprising a plurality of nozzles, each fluid ejection die of the plurality in fluid communication with a respective fluid communication channel, each fluid ejection die aligned with the respective fluid communication channel, and each nozzle to dispense printing material received from the respective channel; and a respective conductive trace electrically connected to each fluid ejection die of the plurality, each respective conductive trace passing through a respective conductive trace opening formed through the glass-based support substrate.

2. The fluid ejection device of claim 1, further comprising:

an insulating material encapsulating at least a portion of each respective conductive trace.

3. The fluid ejection device of claim 1, wherein the glass-based support substrate has a width, and the fluid ejection dies of the plurality are generally arranged end-to-end along the width of the glass-based support substrate.

4. The fluid ejection device of claim 1, wherein the plurality of fluid ejection dies comprise a first set of fluid ejection dies and a second set of fluid ejection dies, the glass-based support substrate has a width, the first set of fluid ejection dies are generally arranged end-to-end along the width of the glass-based support substrate in a first print order position, and the second set of fluid ejection dies are generally arranged end-to-end along the width of the glass-based support substrate in a second print order position.

5. A process comprising:

coupling at least one fluid ejection die to a glass-based support substrate, the at least one fluid ejection die comprising at least one nozzle to dispense printing material, and the fluid ejection die comprising a fluid feed hole corresponding to the at least one nozzle; and removing a portion of the glass-based support substrate and a portion of the fluid ejection die to thereby form at least one fluid communication channel passing through the glass-based support substrate and aligned with at least one fluid feed hole, the at least one fluid communication channel fluidly connected to the at least one fluid feed hole and the at least one nozzle, and the at least one fluid communication channel aligned with the at least one fluid feed hole.

6. The process of claim 5, wherein removing the portion of the glass-based support substrate and the portion of the fluid ejection die to thereby form the at least one fluid communication channel comprises slot-plunge cutting the glass-based support substrate and the fluid ejection die.

7. The process of claim 5, wherein coupling the at least one fluid ejection die to the glass-based support substrate comprises:

applying an adhesive to a surface of the glass-based support substrate;

attaching the at least one fluid ejection die to the applied adhesive; and curing the adhesive, glass-based support substrate, and the attached at least one fluid ejection die.

8. The process of claim 5, wherein the at least one fluid ejection die comprises a plurality of fluid ejection dies, and the plurality of fluid ejection dies are generally arranged end-to-end across a width of the glass-based support substrate.

9. The process of claim 5, further comprising: electrically connecting at least one conductive trace to the at least one fluid ejection die; and encapsulating at least a portion of the at least one conductive trace and at least a portion of the at least one fluid ejection die with an insulating material to thereby electrically insulate the connection therebetween.

10. The process of claim 5, further comprising:

forming a conductive trace opening through the glass-based support substrate; and electrically connecting at least one conductive trace to the at least one fluid ejection die, wherein the at least one conductive trace passes through the conductive trace opening.

11. The process of claim 5, wherein the glass-based support substrate is at least semi-transparent, and coupling the comprises at least one of:

applying an ultraviolet light curable adhesive to a surface of the glass-based support substrate;

attaching the at least one fluid ejection die to the applied ultralight curable adhesive; and exposing the ultraviolet light curable adhesive with an ultraviolet light passing through the semi-transparent glass-based substrate to thereby cure the ultraviolet light curable adhesive.

12. The process of claim 5, wherein the glass based support substrate comprises at least one of: silica based glass, quartz glass, soda-lime glass, borosilicate glass, aluminosilicate glass, alkaline earth boro-aluminosilicate, alkali-aluminosilicate, photosensitive/photodefinable glass, polymer glass, or any combination thereof.

13. A fluid ejection device comprising:

a fluid ejection die comprising a plurality of nozzles and at least one respective fluid feed hole in fluid communication with each nozzle of the plurality of nozzles, and each nozzle is to dispense printing material; and a glass-based support substrate coupled to the fluid ejection die on a first surface of the glass-based support substrate, the glass-based support substrate having a fluid communication channel formed therethrough, the fluid communication channel aligned to the at least one respective fluid feed hole and in fluid communication with the at least one respective fluid feed hole, and the glass based support substrate has a conductive trace opening formed therethrough;

at least one conductive trace electrically connected to the fluid ejection die, the at least one conductive trace having a first portion positioned on the first surface of the glass-based support substrate, the at least one conductive trace has a second portion that passes through the conductive trace opening, and the at least one conductive trace has a third portion that is positioned on a second surface of the glass-based support substrate; and an insulating material that encapsulates the first portion of the at least one conductive trace and at least a portion of the fluid ejection die to thereby insulate the electrical connection of the at least one conductive trace and the fluid ejection die.

14. The fluid ejection device of claim 13, wherein the glass-based support substrate comprises at least one of: silica based glass, quartz glass, soda-lime glass, borosilicate glass, aluminosilicate glass, alkaline earth boro-aluminosilicate, alkali-aluminosilicate, photosensitive/photodefinable glass, polymer glass, or any combination thereof, or any combination thereof.

* * * * *